United States Patent [19]

Akkala

[11] 4,150,519

[45] Apr. 24, 1979

[54] PACKAGING APPARATUS

[75] Inventor: Walter I. Akkala, Neenah, Wis.

[73] Assignee: American Can Company, Greenwich, Conn.

[21] Appl. No.: 904,377

[22] Filed: May 10, 1978

[51] Int. Cl.[2] ..... B65B 43/30; B31B 11/00

[52] U.S. Cl. ..... 53/175; 53/386; 93/36.01

[58] Field of Search ..... 53/175, 386; 93/36.01

[56] References Cited

U.S. PATENT DOCUMENTS

| | | | |
|---|---|---|---|
| 3,774,509 | 11/1973 | Heinzer | 53/175 X |
| 4,089,255 | 5/1978 | Akoh et al. | 53/175 X |

*Primary Examiner*—Travis S. McGehee

*Attorney, Agent, or Firm*—Robert P. Auber; Harry W. Hargis, III; Ira S. Dorman

[57] ABSTRACT

In plastic pouch forming structure, a pair of vacuum ports such as, for example, cups are provided in each of a pair of opposed vacuum boxes that are horizontally movable toward and away from one another. Each vacuum cup comprises an insert having a first half-face portion that is substantially flush with the vacuum cup's sealing surface, and a second half face portion that is recessed as respects the first face portion. The dividing line between the face portions is essentially a vertically extending edge of the first face portion offset laterally as respects the diameter of the cup. A flattened, gusseted-bottom pouch is placed between the vacuum boxes, in closely spaced relation thereto, and a vacuum is introduced to force the confronting flat surfaces of the pouch onto the vacuum cups and partially into the recessed portions thereof, forming an initial crease on the vertical edge which extends downwardly toward the gusseted bottom of the pouch as the vacuum boxes are moved apart, and partially squaring the cross-sectional configuration of the pouch for insertion of a forming mandrel fully to square up the pouch and move it into a carton or carrier for subsequent filling.

10 Claims, 9 Drawing Figures

PACKAGING APPARATUS

BACKGROUND OF THE INVENTION

This invention relates to packaging apparatus, and more particularly to apparatus useful in forming pouches to facilitate insertion of articles therein.

In the food packaging art is has been a practice to provide apparatus for opening a flat, gusseted-bottom pouch and inserting therein a rectangular ram operable to shape the pouch and insert it into a rectangular carton or carrier for filling.

Difficulties are encountered frequently in that the pouch walls do not always readily conform to the shape of the ram and carton, leading to difficulties in subsequent filling with, for example, predetermined volumes of foods or the like, for subsequent sealing.

The following is a listing of U.S. Patents believed material to the examination of this application, together with a concise explanation of the relevance of each:

U.S. Pat. No. 2,224,656 discloses opposed suction devices movable toward one another to engage a flattened bag and movable apart to open the bag.

U.S. Pat. No. 2,281,516 discloses opposed suction boxes A for opening collapsed bags B in preparation for filling.

U.S. Pat. No. 3,453,799 discloses pouch opening apparatus, including suction cups 54, each provided with a flat edge portion 54*a* for eliminating tendency of the pouch wall to become wrinkled.

U.S. Pat. No. 3,706,179 discloses suction means for removing a bag from a hopper and onto holding means 30 for insertion of a product as indicated in FIG. 3 thereof.

U.S. Pat. No. 4,033,096 discloses opposed pairs of suction cups 6 and 9 operative to engage and spread the walls of flattened pouch 1.

It is a general objective of the invention to provide improved apparatus of the foregoing type ensuring full opening of a pouch to a rectangular, set-up configuration.

It is a further and more specific objective of the invention to provide improved suction cup apparatus operative to engage and form a crease of predetermined configuration in a plastic film.

A still further objective of the invention is the provision of improvements in pouch filling apparatus enhancing its reliability and economy of operation.

SUMMARY OF THE INVENTION

In achievement of the foregoing as well as other objectives and advantages, the invention contemplates, in packaging apparatus, means for handling a flattened pouch having opposed planar walls joined along side portions thereof to define an opening for receiving material to be packed, the combination comprising: a pair of opposed vacuum box means mounted for movements toward and away from one another; means disposed on each said vacuum box means defining a pair of mutually spaced vacuum ports in fluid flow communication with a corresponding one of said vacuum box, means each said port being defined in part by at least one elongate edge portion extending transversely of said opening, parallel to the edge portion defining a part of an opposed port, and in the direction of a corner fold to be formed in a pouch; means for moving said vacuum box means toward one another into position engaging the recited walls of a flattened pouch in the region of its opening; means for introducing a vacuum through said vacuum box means to urge portions of said pouch walls over said vacuum port edges to initiate formation of a crease in said pouch walls extending in the direction of a desired corner fold; and means for moving said vacuum box means apart to urge said pouch walls apart to positions causing said creases to extend along regions of said pouch walls beyond the recited initially formed creases, thereby to form said corner folds for shaping said pouch in a substantially rectangular cross-sectional configuration.

The manner in which the foregoing as well as other objectives and advantages of the invention may best be achieved will be more fully understood from a consideration of the following description, taken in light of the accompanying drawing.

DESCRIPTION OF THE PREFERRED EMBODIMENT

Figure 1:
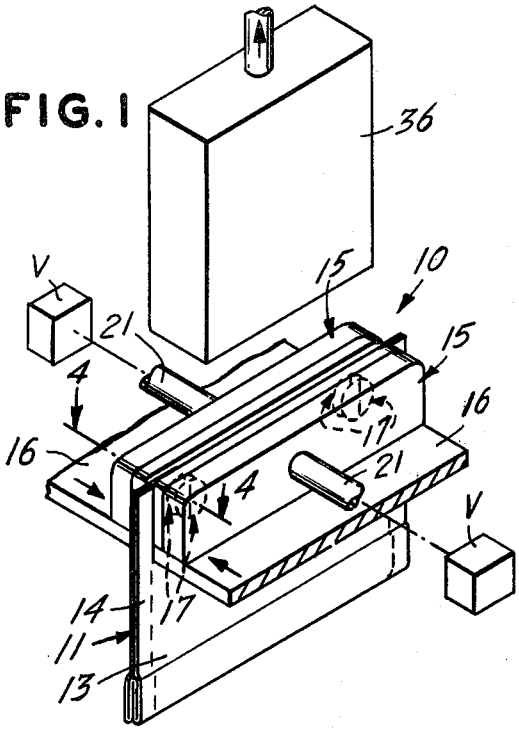
FIGS. 1, 2, and 3 are perspective showings of portions of a pouch opening apparatus embodying the invention, and illustrating sequential stages of its operation.
Figure 2:
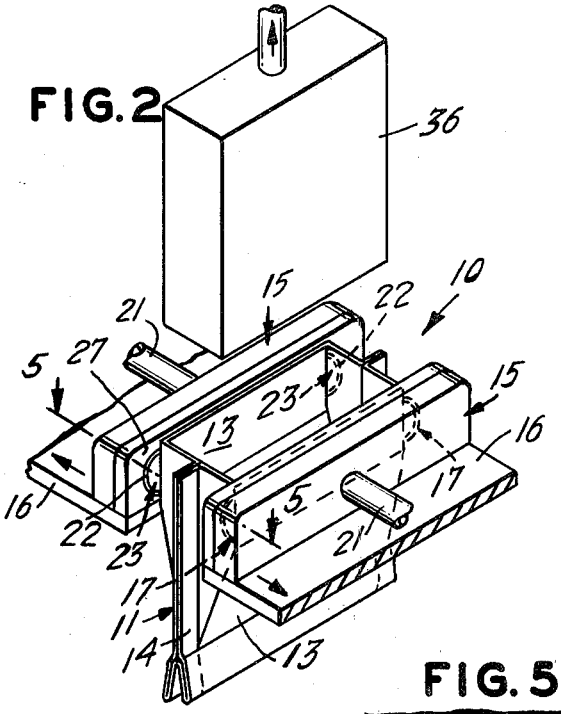
Figure 3:
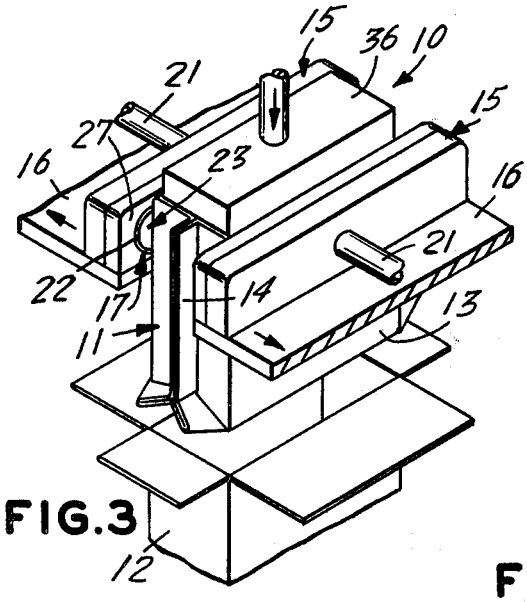

With more detailed reference to the drawing, there is seen in FIGS. 1 to 3 pouch handling apparatus 10 for opening and transforming a pouch 11 from flattened configuration (FIG. 1) into rectangular cross-sectional configuration (FIGS. 2 and 3) for insertion into a carton 12 (FIG. 3), or other suitable means, for subsequent filling and sealing by conventional means which need not be shown for an understanding of the present invention.

Pouch 11 is formed from a single rectangular sheet of flexible, synthetic-resin foil-type material 13 folded onto itself so that it is W-shaped in vertical section and sealed along its edges, as seen at 14, to form an open-top container capable of being opened and transformed into generally rectangular cross section for filling.

Handling apparatus 10 comprises means defining a pair of opposed vacuum box means 15 mounted on brackets 16 for movements toward and away from one another (see directional arrows, FIGS. 1, 2, and 3). Each vacuum box 15 is provided with a pair of mutually spaced vacuum ports 17 disposed in fluid flow communication therewith, and a controlled source of vacuum of known type, and shown diagramatically at V (FIG. 1), is connected thereto through tubes 21. As is best seen in FIGS. 4 to 7, each port 17 is defined by a vacuum cup 22 of flexible and resilient material provided with an insert 23 of a relatively solid material. Each cup 22 is of frusto-conical configuration nested within a similarly shaped opening 28 in wall 27 of box means 15. Cup 22 includes a lesser diameter tubular portion 24 coaxial therewith, and frictionally retained, with the aid of a flange 25, within an opening 26 also in the front wall 27 of box 15 and coaxial with opening 28.

Each insert 23 comprises a tubular portion 29 frictionally retained in the bore of tubular portion 24, and provided with a flange 30 to aid in its retention. Each insert 23 further includes a frusto-conical portion of the vacuum port communicating with the interior of vacuum box means 15, and the port's pouch engaging portion is characterized by its definition in part by an elongated edge portion 33 that extends transversely of bore 32, and is disposed slightly laterally thereof. Edge portion 33 defines an edge of a base portion 34 of conical insert 23 that is disposed substantially in the plane of the base of vacuum cup 22. A base portion 35 of conical insert 23 is recessed as respects base portion 34. Thus, base portions 34 and 35 of inserts 23 are, respectively, first and second vacuum port face portions divided by edge portion 33, each of the latter being parallel to the edge portions of the opposed as well as the adjacent ports of the confronting vacuum box means. Inserts 23 further are disposed in each box 15 so that base or face portions 34 are at the outer end portions of each box means, whereas recessed portions 35 are in the inner portions, more closely spaced as respects one another.

A forming mandrel 36 of rectangular configuration is mounted above vacuum box means 15 and is movable vertically (see directional arrows, FIGS. 1, 2, and 3), by conventional means not shown, between the retracted position seen in FIGS. 1 and 2 and the partially extended position, seen in FIG. 3, and to a fully extended position not shown but to be described in what follows.

Figure 4:
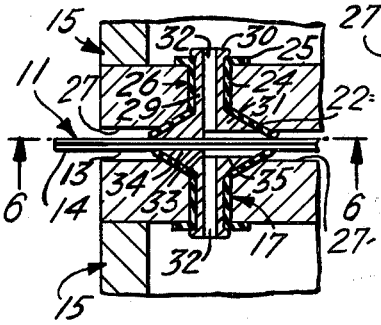
FIG. 4 is an enlarged sectional view of FIG. 1, taken generally in the plane of line 4—4, and looking in the direction of the arrows applied thereto.

Considering operation of the apparatus thus far described, and with reference first to FIGS. 1 and 4, a flattened pouch 11 to be opened and filled is moved between vacuum boxes 15 by known suitable apparatus, and the box means are then moved toward one another to clamp the pouch in the position shown. More particularly, pouch 11 is engaged by rim portions of vacuum cups 22, and, through slight deflection thereof, further are engaged by base portions 34 of inserts 23, to form a fluid seal against the walls of the pouch, in the regions of the upper corners of the latter. While thus engaged, a vacuum is applied to box means 15 from source V through their respective tubes 21, drawing portions of flexible pouch walls into the D-shaped regions defined by edge portions 33 and the rim portions of cups 22 dispposed about the recessed portions 35 of inserts 23. In especial accordance with the invention, drawing portions of the pouch walls 13 over edge portions 33 of the vacuum cup inserts forms creases in the held wall portions.

Figure 5:
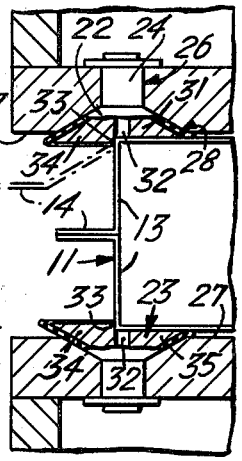
FIG. 5 is an enlarged sectional view of FIG. 2, taken generally in the plane of line 5—5, and looking in the direction of arrows applied thereto.
Figure 6:
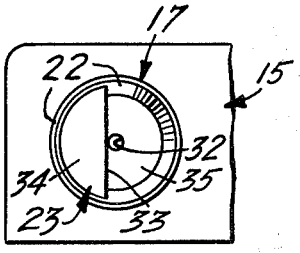
FIG. 6 is an elevational showing of a portion of the apparatus seen in FIG. 4, taken in the plane of line 6—6, and looking in the direction of arrows applied thereto.
Figure 7:
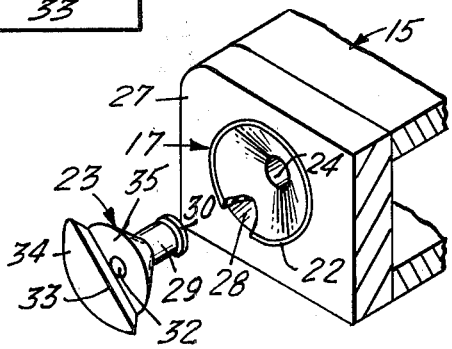
FIG. 7 is a partially exploded view, in perspective, of a portion of the apparatus illustrated in FIG. 6.

As is seen in FIGS. 2 and 5, vacuum box means 15 have been moved apart a distance about the same as the lengths of the portion of pouch wall between the edge portions 33 and the seams 14. Movement of box means 15 causes portions of the pouch walls 13 disposed over base portions 34 of inserts 23 to pivot about edge portions 33, thereby creating an initial corner fold in the pouch extending part way down toward its W-shaped, gusseted bottom.

While the box means 15 and pouch walls 13 are so positioned, and with reference to FIG. 3, rectangular shaping mandrel 36 is lowered for insertion into pouch 11 through its squared-up opening, followed by movement to square the lower, gusseted portion of the pouch. Continued downward movement of mandrel 36, accompanied by release of the vacuum on tubes 21 and box means 15, removes the squared-up pouch from retention by vacuum ports 17 and inserts it into a suitably disposed rectangular carton 12 for movement to suitable filling apparatus.

Figure 8:
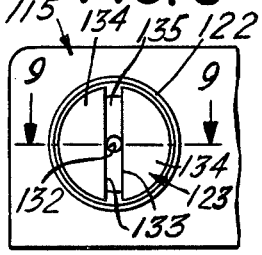
FIG. 8 is an elevational view similar to FIG. 6, and illustrating a modified embodiment of the invention.
Figure 9:
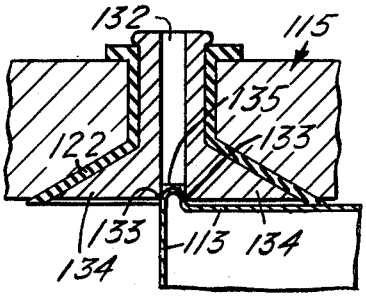
FIG. 9 is an enlarged sectional view of FIG. 8, taken in the plane of line 9—9, looking in the direction of arrows applied thereto, and including a sectional showing of a portion of a pouch.

A modified embodiment of the invention is seen in FIGS. 8 and 9, in which an insert 123 has a base portion 134 provided with a diametrically extending groove defined by a pair of edge portions 133 of base portions 134 in combination with recessed portion 135, with which groove the bore 132 is in fluid flow communication. Application of a vacuum to bore 132 will draw a portion of a bag wall 113 into the groove to form a bead (FIG. 9) the same width as the distance between edges portions 133 of the groove. As the vacuum boxes are moved apart, the end portions of pouch walls 113 pivot about the outer edge portions 133 forming an initial fold that will travel to the bottom of the pouch upon insertion of a forming mandrel, as in the case of the preceding embodiment.

In either of the disclosed embodiments, it will be appreciated that formation of the initial creases advantageously reduces friction between the forming mandrel and relatively fragile walls of the pouch.

While a pair of embodiments of the invention have been disclosed, it will be understood that the invention is susceptible of such other modifications as may fall within the scope of the appended claims.

I claim:

1. In means for handling a flattened pouch having opposed planar walls joined along side portions thereof to define an opening for receiving material to be packed, the combination comprising: a pair of opposed vacuum box means mounted for movements toward and away from one another; means disposed on each said vacuum box means defining a pair of mutually spaced vacuum ports in fluid flow communication with a corresponding one of said vacuum box means, each said port being defined in part by at least one elongate edge portion extending transversely of said opening, parallel to the edge portion defining a part of an opposed port, and in the direction of a corner fold to be formed in a pouch; means for moving said vacuum box means toward one another into position engaging the recited walls of a flattened pouch in the region of its opening; means for introducing a vacuum through said vacuum ports upon engagement of said pouch walls by said vacuum box means to urge portions of said pouch walls over said vacuum port edges to initate formation of a crease in said pouch walls extending in the direction of a desired corner fold; and means for moving said vacuum box means apart to urge said pouch walls apart to positions causing said creases to extend along regions of said pouch walls beyond the recited initially formed creases, thereby to form said corner folds for shaping said pouch in a substantially rectangular cross-sectional configuration.

2. The combination according to claim 1, and characterized in that each said vacuum port is of elongate configuration and defined by a pair of recited edge portions disposed in mutually confronting, spaced, parallel relationship.

3. The combination according to claim 1, and characterized in that each said vacuum port comprises a suction cup of generally frusto-conical configuration having a central opening in the lesser diameter portion thereof in fluid flow communication with said vacuum box means, the greater diameter portion of said cup disposed substantially in the plane of a pouch wall upon the recited engagement thereof, said cup being formed of a flexible and resilient material, and an insert for said cup including a tubular portion frictionally retained coaxially in said opening and further including a first face portion substantially coplanar with the recited greater diameter portion of said cup and a second face portion recessed in said cup as respects said first face portion, said first and second face portions divided by said elongate edge portion.

4. The combination according to claim 1, and characterized in that each said vacuum port comprises a suction cup of generally frusto-conical configuration having a central opening in the lesser diameter portion thereof in fluid flow communication with said vacuum box means, the greater diameter portion of said cup disposed substantially in the plane of a pouch wall upon the recited engagement thereof, said cup being formed of a flexible and resilient material, and an insert for said cup including a tubular portion frictionally retained coaxially in said opening and further including a face portion substantially coplanar with the recited greater diameter portion of said cup, and an elongate, diametrically extending slot included in said face portion in fluid flow communication with said central opening and defining said vacuum port.

5. The combination according to claims 2, 3, or 4, and characterized by the inclusion of means defining a forming mandrel of rectangular configuration and mounted for movement into a pouch to form the same upon the recited movement of said vacuum box means apart.

6. In apparatus for opening a flattened pouch of the type including opposed planar walls joined along side portions thereof to define a closed end and an open end for receiving material to be packed, the combination comprising: means defining a first pair of mutually spaced vacuum ports, and a second pair of mutually spaced vacuum ports, and first and second pairs mounted for movements toward and away from one another, respectively to engage opposed side walls of a closed pouch, and to open same while so engaged; said vacuum ports of a pair being defined by means including substantially coplanar openings; means defining an edge extending transversely of each said opening, parallel to one another, and in the direction of a corner fold to be formed in a pouch for extension between its open and closed ends; and means for introducing a vacuum into each said pair of ports upon movements thereof toward one another to engage a pouch, and for maintaining said vacuum as said pairs of ports are moved apart, each said edge extending over one of said openings being effective initially to form a crease in an engaged pouch wall about which said wall is foldable as said pairs of ports are moved apart.

7. The combination according to claim 6, and characterized in that each said vacuum port is of elongate configuration and defined by a pair of recited edge portions disposed in mutually confronting, spaced, parallel relationship.

8. The combination according to claim 6, and characterized in that each said vacuum port comprises a suction cup of generally frusto-conical configuration having a central opening in the lesser diameter portion thereof in fluid flow communication with said means for introducing a vacuum, the greater diameter portion of said cup disposed substantially in the plane of a pouch wall upon the recited engagement thereof, said cup being formed of a flexible and resilient material, and an insert for said cup including a tubular portion frictionally retained coaxially in said opening and further including a first face portion substantially coplanar with the recited greater diameter portion of said cup and a second face portion recessed in said cup as respects said first face portion, said first and second face portions divided by said elongate edge portion.

9. The combination according to claim 6, and characterized in that each said vacuum port comprises a suction cup of generally frusto-conical configuration having a central opening in the lesser diameter portion thereof in fluid flow communication with said means for introducing a vacuum, the greater diameter portion of said cup disposed substantially in the plane of a pouch wall upon the recited engagement thereof, said cup being formed of a flexible and resilient material, and an insert for said cup including a tubular portion frictionally retained coaxially in said opening and further including a face portion substantially coplanar with the recited greater diameter portion of said cup, and an elongate, diametrically extending slot included in said face portion in fluid flow communication with said central opening and defining said vacuum port.

10. The combination according to claims 7, 8, or 9 and characterized by the inclusion of means defing a forming mandrel of rectangular configuration and mounted for movement into a pouch to form the same upon the recited movement of said pairs of spaced ports apart.

* * * * *